US008297192B2

(12) United States Patent
Hays et al.

(10) Patent No.: US 8,297,192 B2
(45) Date of Patent: Oct. 30, 2012

(54) INSENSITIVE MUNITIONS WARHEAD EXPLOSIVE VENTING SYSTEM

(75) Inventors: Brian Vance Hays, Ridgecrest, CA (US); Lee Hardt, Ridgecrest, CA (US); Donald Burnett, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1078 days.

(21) Appl. No.: 12/143,969

(22) Filed: Jun. 23, 2008

(65) Prior Publication Data

US 2011/0056403 A1 Mar. 10, 2011

Related U.S. Application Data

(62) Division of application No. 11/472,515, filed on Jun. 15, 2006, now Pat. No. 7,472,653.

(51) Int. Cl.
*F41A 9/00* (2006.01)

(52) U.S. Cl. ..... 102/481

(58) Field of Classification Search ..... 102/481, 102/514; 89/1.812; 60/233
See application file for complete search history.

(56) References Cited

U.S. PATENT DOCUMENTS

| | | | | |
|---|---|---|---|---|
| 2,958,185 | A * | 11/1960 | Sanders | 60/223 |
| 5,044,154 | A * | 9/1991 | English et al. | 60/223 |
| 6,523,477 | B1 * | 2/2003 | Brooks et al. | 102/481 |
| 2005/0193917 | A1 * | 9/2005 | Friedlander, III | 102/481 |

* cited by examiner

*Primary Examiner* — Daniel Troy
(74) *Attorney, Agent, or Firm* — Christopher L. Blackburn; David S. Kalmbaugh

(57) ABSTRACT

A venting system for a casing containing an explosive material includes a base plug having one or more venting ports. A ring-shaped failure mechanism mounted to the base plug seals the venting ports. The failure mechanism has a selected melting temperature such that raising the temperature of the failure mechanism to its melting temperature causes the failure mechanism to unseal the venting port to allow controlled burning of the explosive material. An insert ring formed of a durable material to protect the failure mechanism from being damaged may be mounted on an outer surface of the failure mechanism. An adhesive may be used to seal gaps between the failure mechanism, the insert ring and the base plug. The failure mechanism may have a peripheral tab formed to fit within a corresponding groove in the base plug to mount the failure mechanism securely to the base plug.

3 Claims, 10 Drawing Sheets

INSENSITIVE MUNITIONS WARHEAD EXPLOSIVE VENTING SYSTEM

This application is a divisional application of U.S. patent application Ser. No. 11/472,515, filed Jun. 15, 2006 now U.S. Pat. No. 7,472,653.

BACKGROUND OF THE INVENTION

1. Field of the Invention

This invention relates generally to ordnance casings and particularly to a bomb casing having a vented base plug for providing a controlled burn of explosive material in the bomb casing to prevent an explosion from occurring in the event that the bomb casing is exposed to a high temperature environment.

2. Description of the Prior Art

Insensitive munitions have become very important in national defense technology. Many weapons developed in the past did not take into account all of the severe environments that a weapon may encounter during its lifecycle. These environments may include fast burning, excessive heat, impact with bullets and fragments, etc. Many current warhead designs have a case and a closure that has no venting ports or stress risers to allow the explosive to burn or relieve internal pressure resulting from severe heating environments. When such warheads are exposed to a fire, such as could occur on the deck of an aircraft carrier, there is sufficient heat transfer to the explosive material inside of the bomb casing to cause an explosion of the bomb. This could cause significant damage to military systems and serious injury or even death to individuals in proximity to the bomb.

Previous attempts to produce insensitive munitions neither provide a cover to prevent tampering nor cover all hazards of electromagnetic radiation to ordnance and issues related to electrostatic discharge. Prior art devices also fail to provide sealing for high external case pressures that can exist when ordnance is submerged in water.

SUMMARY OF THE INVENTION

The present invention is directed to a warhead venting system that overcomes the foregoing problems. Accordingly, a venting system for a casing for containing an explosive material comprises a base plug having one or more venting port therein. A failure mechanism is mounted to the base plug and arranged to seal the venting ports. The failure mechanism having a selected melting temperature such that exposure of the casing to an environment having a temperature that causes the failure mechanism to melt unseals the venting port to allow controlled burning of the explosive material within the casing.

The base plug preferably includes a generally ring-shaped indent, and the failure mechanism preferably comprises a generally ring-shaped device formed to fit within the ring-shaped indent.

The venting system according to the present invention preferably further includes an insert ring mounted on an outer surface of the failure mechanism. The insert ring is typically formed of a durable material such as steel to protect the failure mechanism from being damaged and to provide shielding from external electromagnetic fields that could detonate the explosive and prevent tampering with the explosive.

A first plurality of fasteners may be used to mount the failure mechanism to the base plug and a second plurality of fasteners may be used to mount the insert ring to the failure mechanism.

An adhesive may be placed between adjacent portions of the failure mechanism and the base plug and between adjacent portions of the insert ring and the base plug to provide additional sealing and retaining capability.

The failure mechanism may be formed as a generally ring-shaped device that includes a peripheral tab arranged to extend into an inner peripheral groove in the indent to facilitate secure mounting of the failure mechanism to base plug.

DETAILED DESCRIPTION OF THE INVENTION

Figure 1:
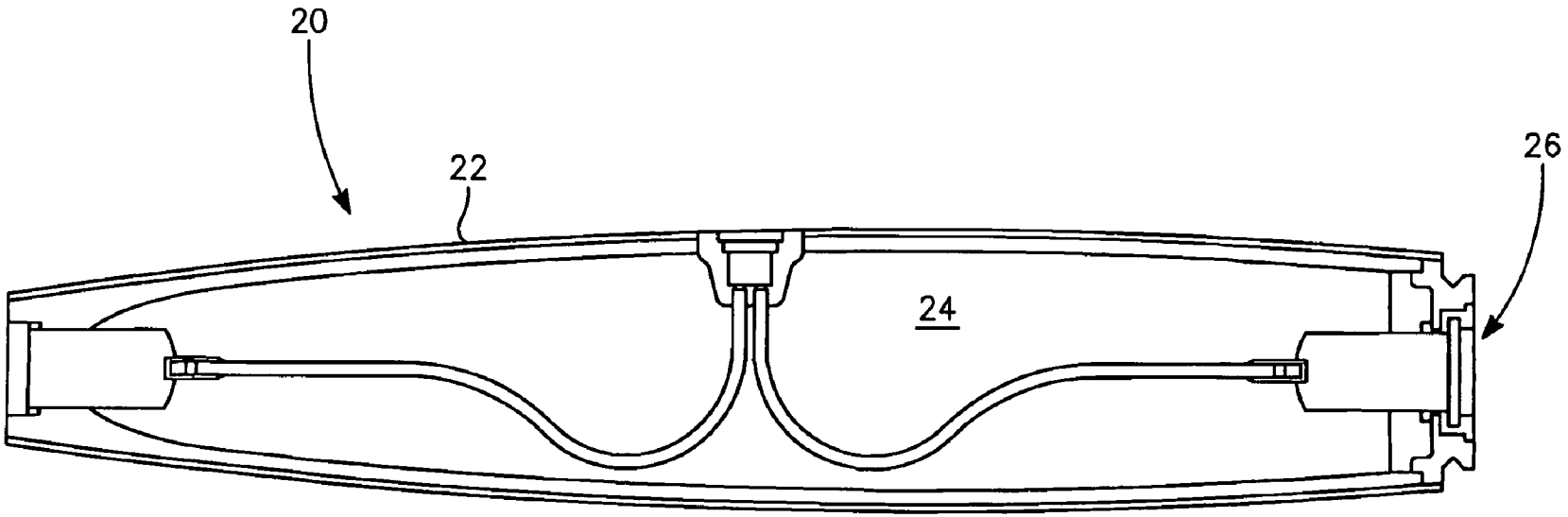
(Prior Art) FIG. 1
FIG. 1 is a cross sectional view showing a prior art warhead casing.

Referring to FIG. 1 a bomb 20 has an unvented casing 22 that contains an explosive material 24. The casing 22 includes a base plug 26 that forms an airtight seal of the explosive material, which is typical of prior art bomb casings.

Figure 2:
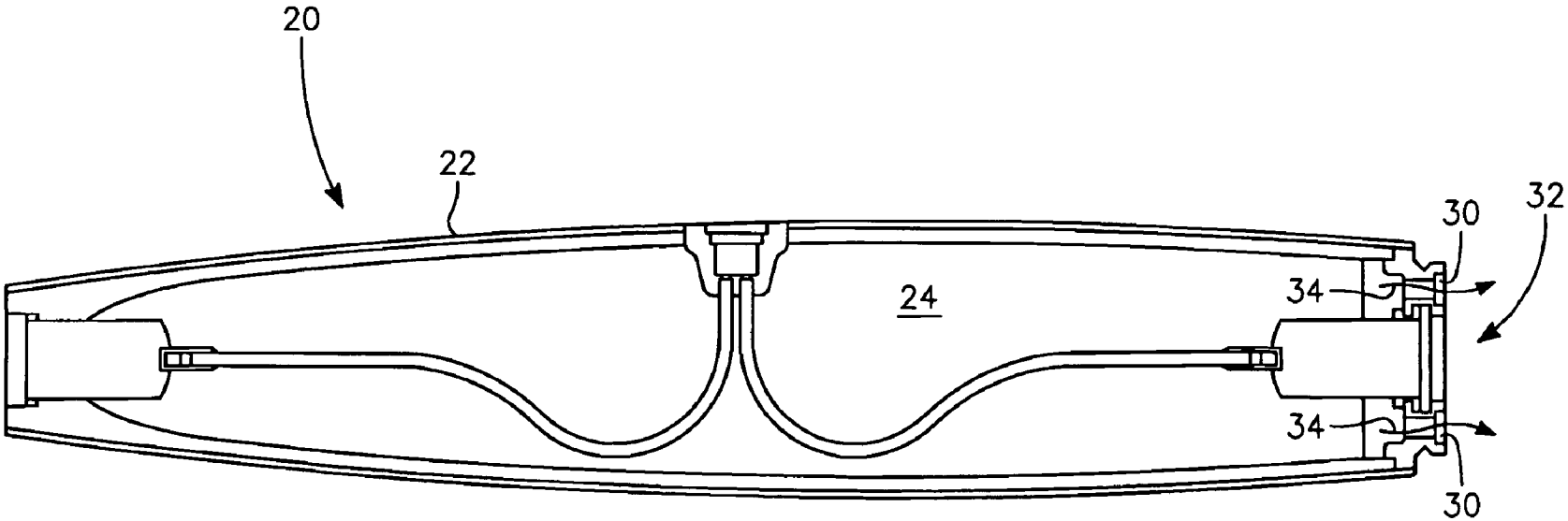
FIG. 2 is a cross sectional view showing a warhead casing having a vented base plug according to the present invention.

FIG. 2 illustrates the current configuration for a bomb 20 which has a plurality of venting ports 30 located within a base plug 32 of the bomb 20. The base plug 32 preferably is formed generally as a cylindrical steel plate. When heat is transferred to the explosive material 24, the venting ports 30 within the base plug 32 allow for a controlled burn of the explosive material 24 within the bomb casing 22 instead of exploding. The venting of the explosive material 24 occurs in the direction indicated by the arrows 34 shown in FIG. 2.

Figure 3:
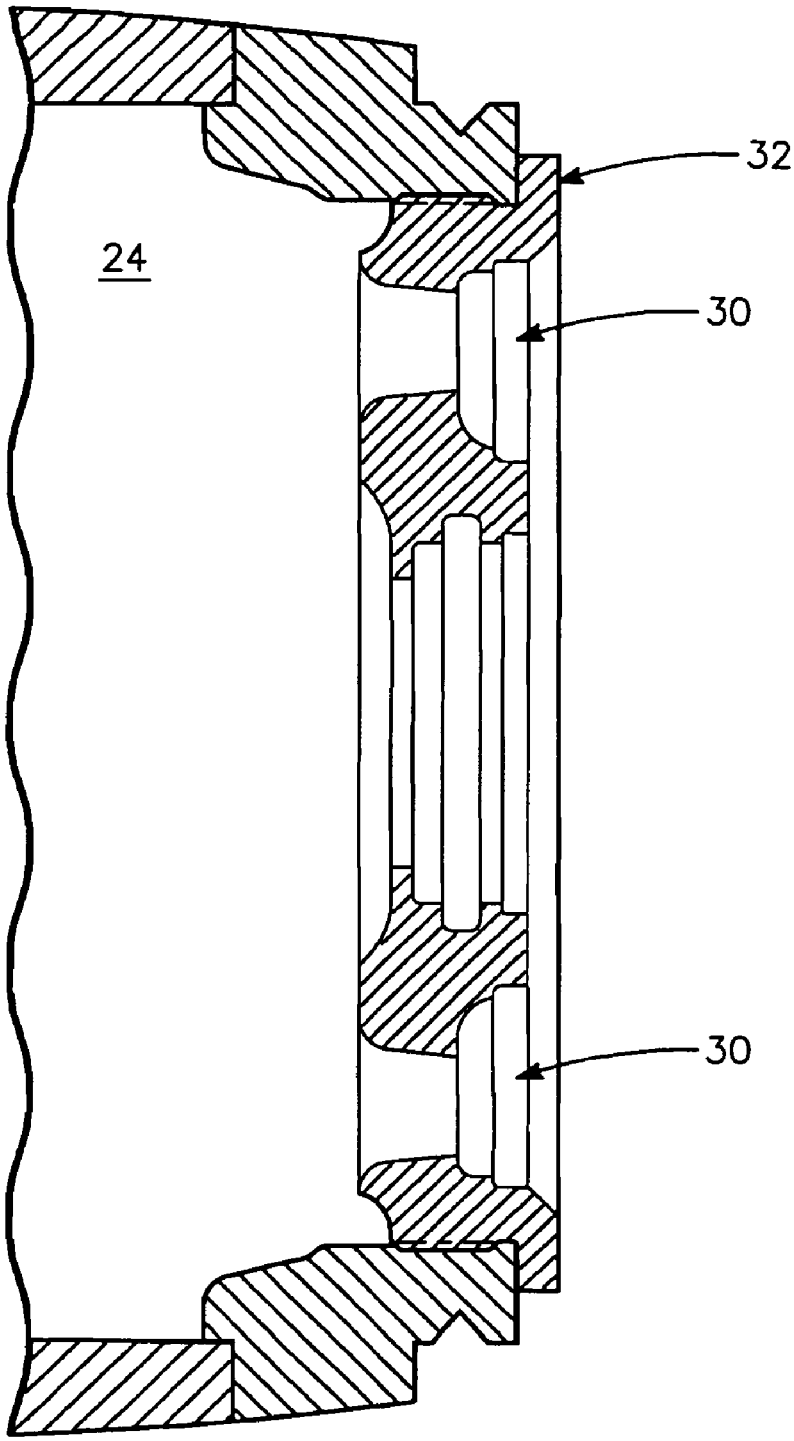
FIG. 3 is an enlarged cross sectional view showing one of the venting ports in the base plug of FIG. 2.
Figure 4:
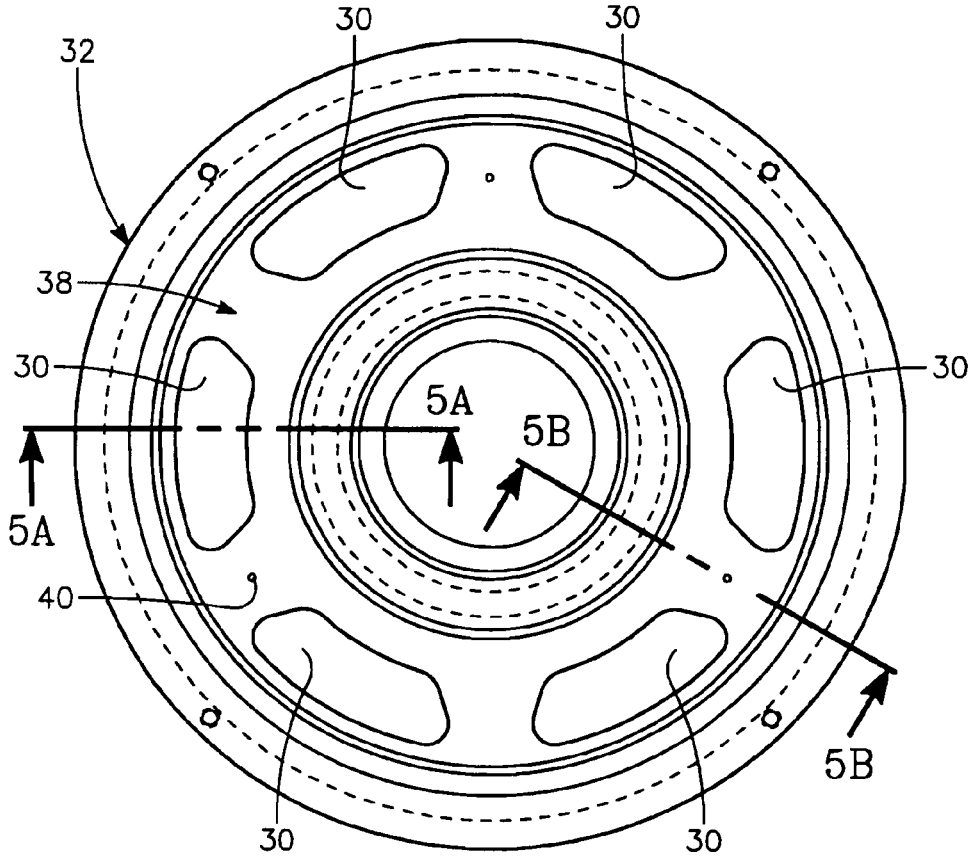
FIG. 4 illustrates six evenly spaced apart venting ports in the base plug.

FIG. 3 is an enlarged cross sectional view of the base plug 32 showing the venting ports 30. FIG. 4 is an end elevation view illustrating the base plug 32. FIG. 4 shows the base plug 32 including six venting ports 30 spaced apart by equal angles. The number of venting ports 30 shown is by way of example. The base plug 32 may have a greater or lesser number of such venting ports 30 depending upon the diameter of the base plug 32 and other parameters such as the characteristics of the explosive material 24 in the bomb 20. Also, the shape of port 30 may vary depending on the structural needs of the base plug 32. The explosive material 24 is thus vented through the venting ports 30 into the atmosphere, which results in a controlled burn in the event that the bomb 20 is exposed to a high temperature environment.

Figure 6:
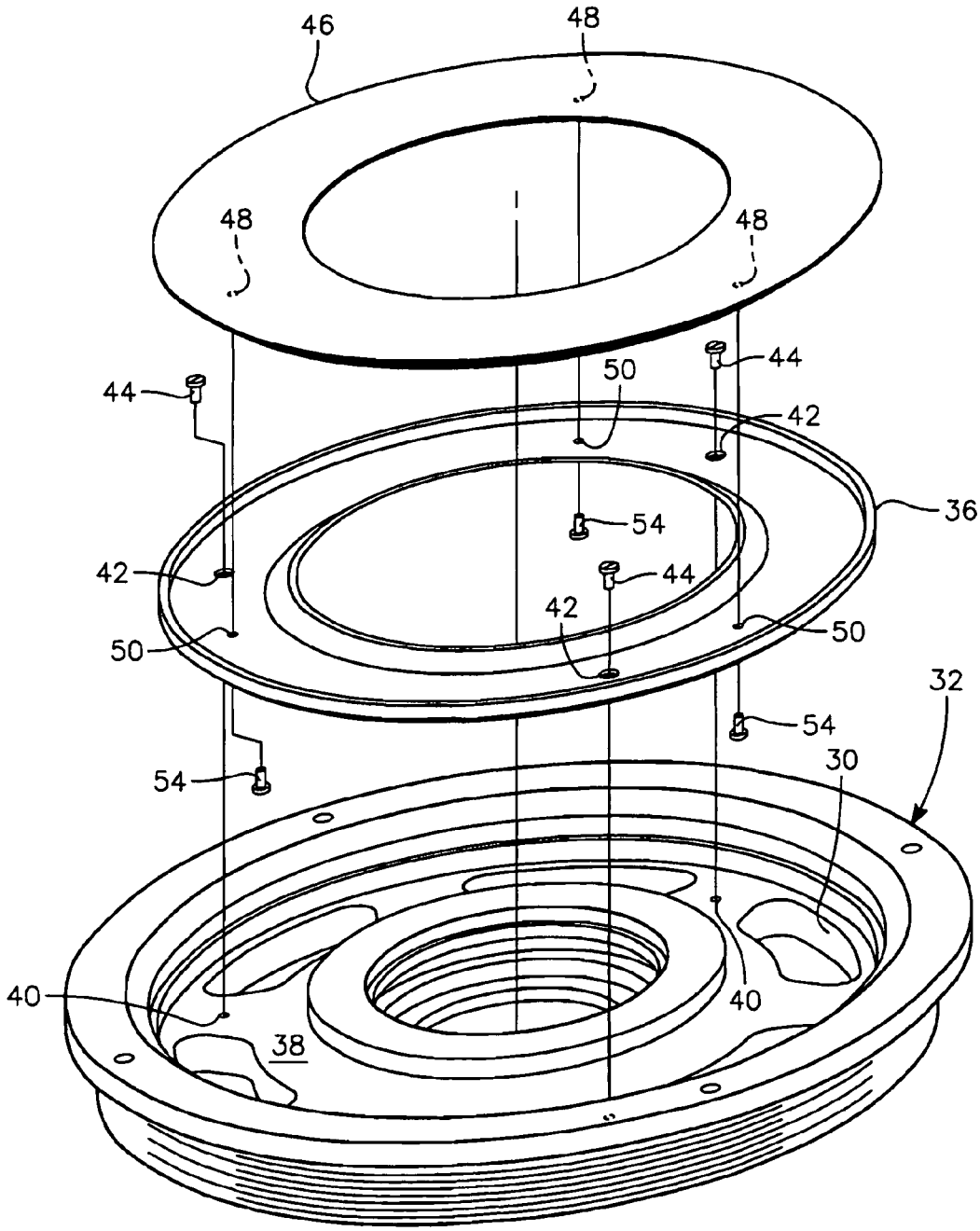
FIG. 6 is an exploded perspective view of the vented base plug assembly of FIG. 4 showing the base plug and a ring-shaped failure mechanism.

FIG. 6 is an exploded perspective view showing the base plug 32, a ring shaped failure mechanism 36 and an insert ring 46. The failure mechanism 36 preferably is fabricated from Acrylonitrile Butadiene styrene or other suitable plastic material. The insert ring 46 is formed of a durable material such as steel. The failure mechanism 36 preferably is a ring-shaped device that is designed to fit within a generally ring shaped indent 38 located in the interior portion of base plug 32.

Figure 5A:
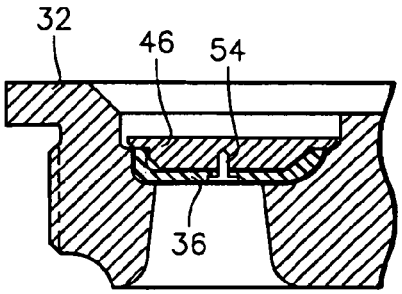
FIG. 5A is a cross sectional view taken along line 5A-5A of FIG. 4 showing attachment of a failure mechanism to an insert ring 46.
Figure 5B:
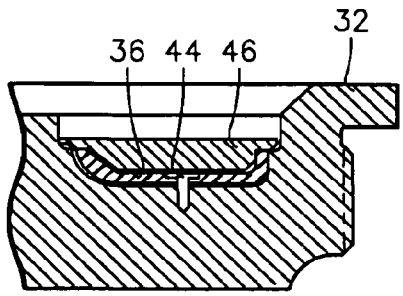
FIG. 5B is a cross sectional view taken along line 5B-5B of FIG. 4 showing attachment of the failure mechanism to the base plug.

Still referring to FIG. 6, the ring shaped failure mechanism 36 is inserted into the indent 38 within base plug 32. Ring shaped failure mechanism 36 is inserted into the indent 38 within base plug 36 with a plurality of counter bored holes 42 within the failure mechanism 36 being aligned with a corresponding plurality of blind holes 40 in the base plug 32 as shown. As shown in FIG. 5B and in FIG. 6, a plurality of fasteners 44 are inserted through the holes 40 and 42 to secure the failure mechanism 36 to the base plug 32.

The insert ring 46 is mounted on an outer surface 47 of the failure mechanism 36. The insert ring 46 has a plurality of blind holes 48 that are aligned with a corresponding plurality of counter bored holes 50 within failure mechanism 36. As shown in FIG. 5A and in FIG. 6, a plurality of fasteners 54 inserted into the blind holes 48 and 50 secure the insert ring 46 to the failure mechanism 36.

Exposure to heat that increases the temperature of the failure mechanism 36 beyond a predetermined value causes the failure mechanism 36 to begin to melt. Melting the failure mechanism 36 releases the failure mechanism 36 and attached insert ring 46 from the base plug 32, which opens the venting ports 30. The insert ring 46 covers the failure mechanism 36 and functions to prevent tampering with the failure mechanism 36, explosive material 24, and also functions as a shielding device to prevent exposure of the failure mechanism 36 to electromagnetic fields external to the casing 22 for preventing electromagnetic discharge of the explosive material 24 within the bomb casing 22. The insert ring 46 also prevents exposure of the failure mechanism 36 to high external case pressures that can exist when ordnance is submerged in water. Without the insert ring 46, such pressures could cause the failure mechanism 36 to deform and become inoperative for its intended purpose.

Figure 7:
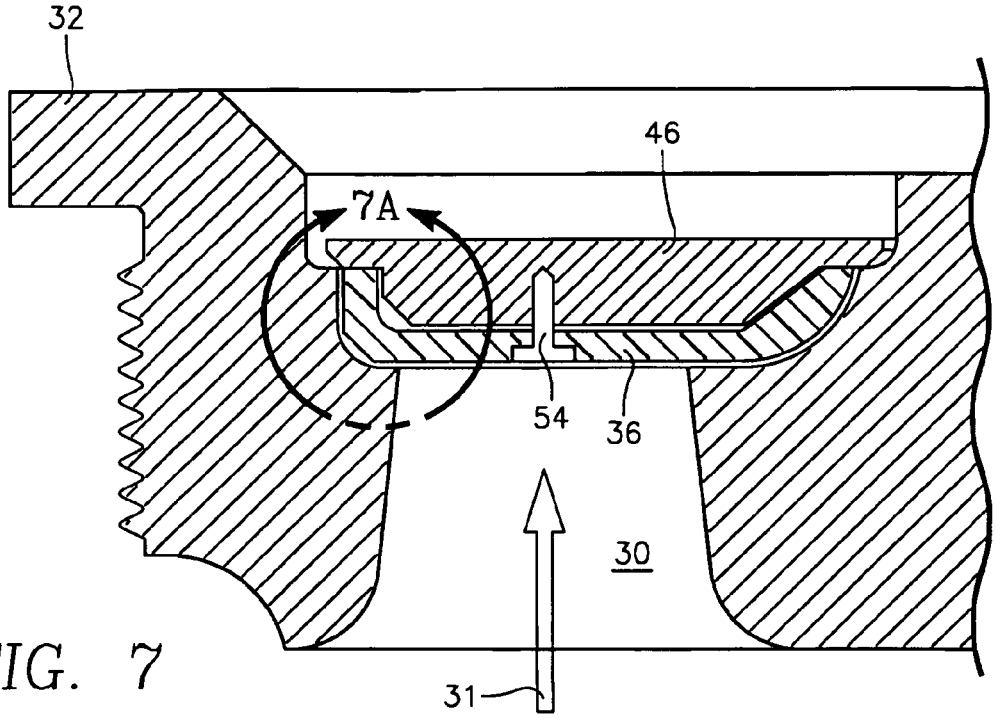
FIGS. 7 and 7A illustrate the use of adhesives between mating surfaces of the insert ring 46, the failure mechanism and the base plug.
Figure 7A:
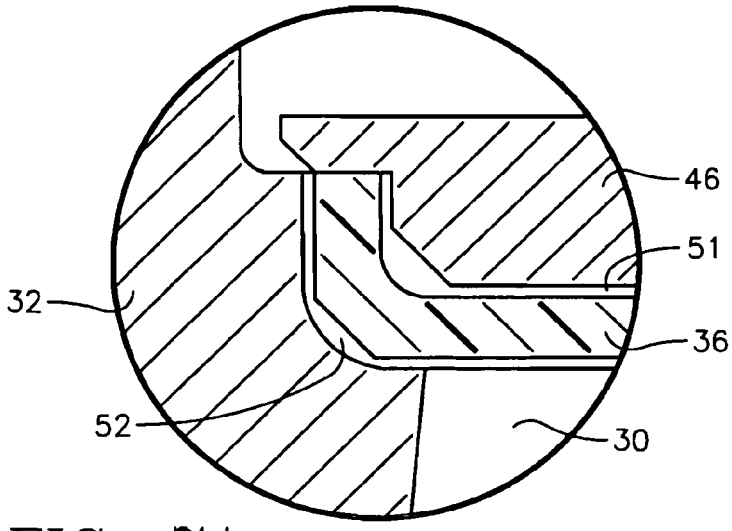
Figure 8:
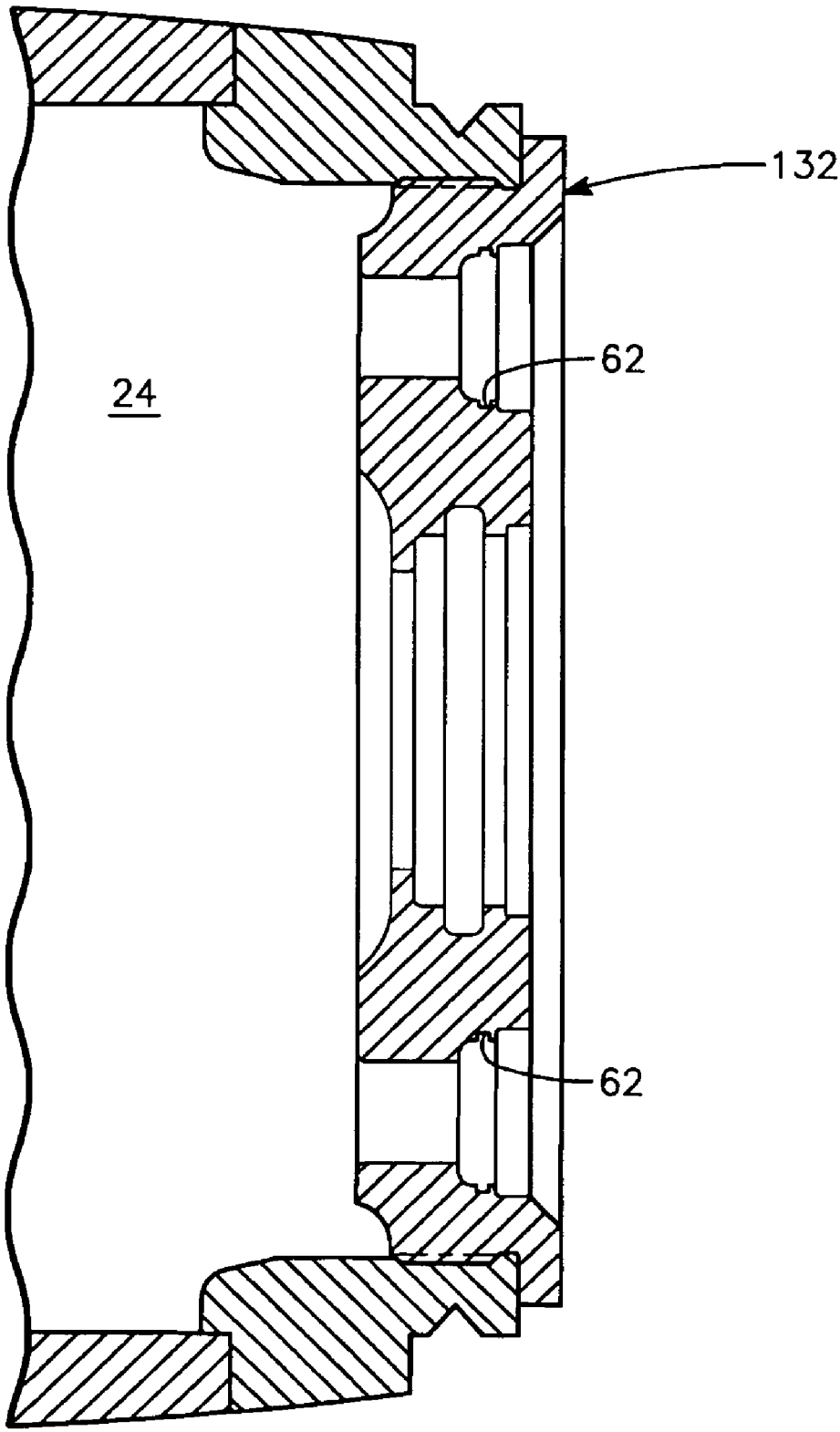
FIG. 8 is a cross sectional view showing a second embodiment of the invention in which the failure mechanism includes a retainer tab that extends into a corresponding grooves in the base plug.
Figure 9:
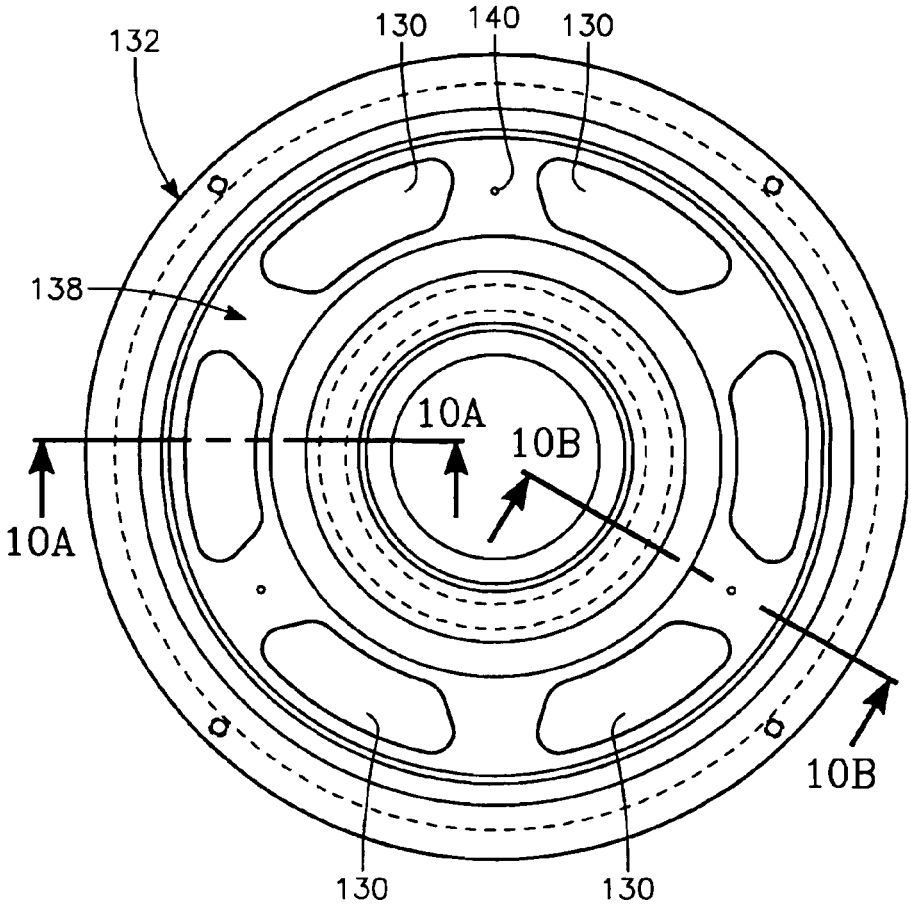
FIG. 9 is an end elevation view of the apparatus of FIG. 8.
Figure 10A:
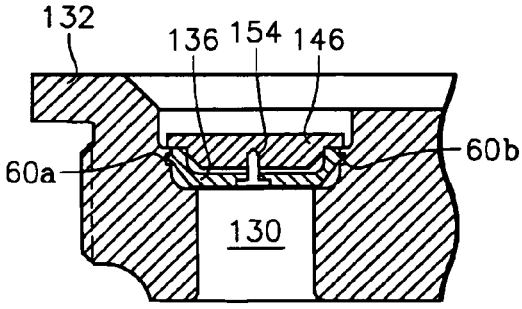
FIG. 10A is a cross sectional view taken along line 10A-10A of FIG. 9 showing attachment of a failure mechanism to an insert ring 146.
Figure 10B:
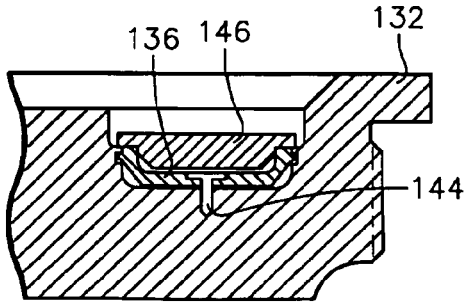
FIG. 10B is a cross sectional view taken along line 10B-10B of FIG. 9 showing attachment of the failure mechanism to the base plug.

As shown in FIGS. 7 and 7A, gaps 51 and 52 are formed between adjacent mating surfaces of the insert ring 46, failure mechanism 36 and base plug 32, respectively. FIGS. 7 and 7A illustrate the use of an adhesive (not shown) in the gaps 51 and 52. The gap 52 between a lower surface 56 of the failure mechanism 36 and an upper surface 58 of the base plug 32 is preferably completely filled with the adhesive. Any excess adhesive is removed before the adhesive cures. Similarly, the gap 51 between an upper surface 60 of the failure mechanism 36 and a lower surface of the insert ring 46 is to be completely filled with adhesive and excess adhesive is to be removed before the adhesive cures. In FIG. 7, the direction of fluid flow through one the six venting ports 30 is indicated by an arrow 31.

As shown in FIGS. 2 and 3, after being assembled together with the failure mechanism 36 and the insert ring 46, the base plug 32 is securely fastened in an opening 63 in an end portion 65 of the casing.

Figure 11:
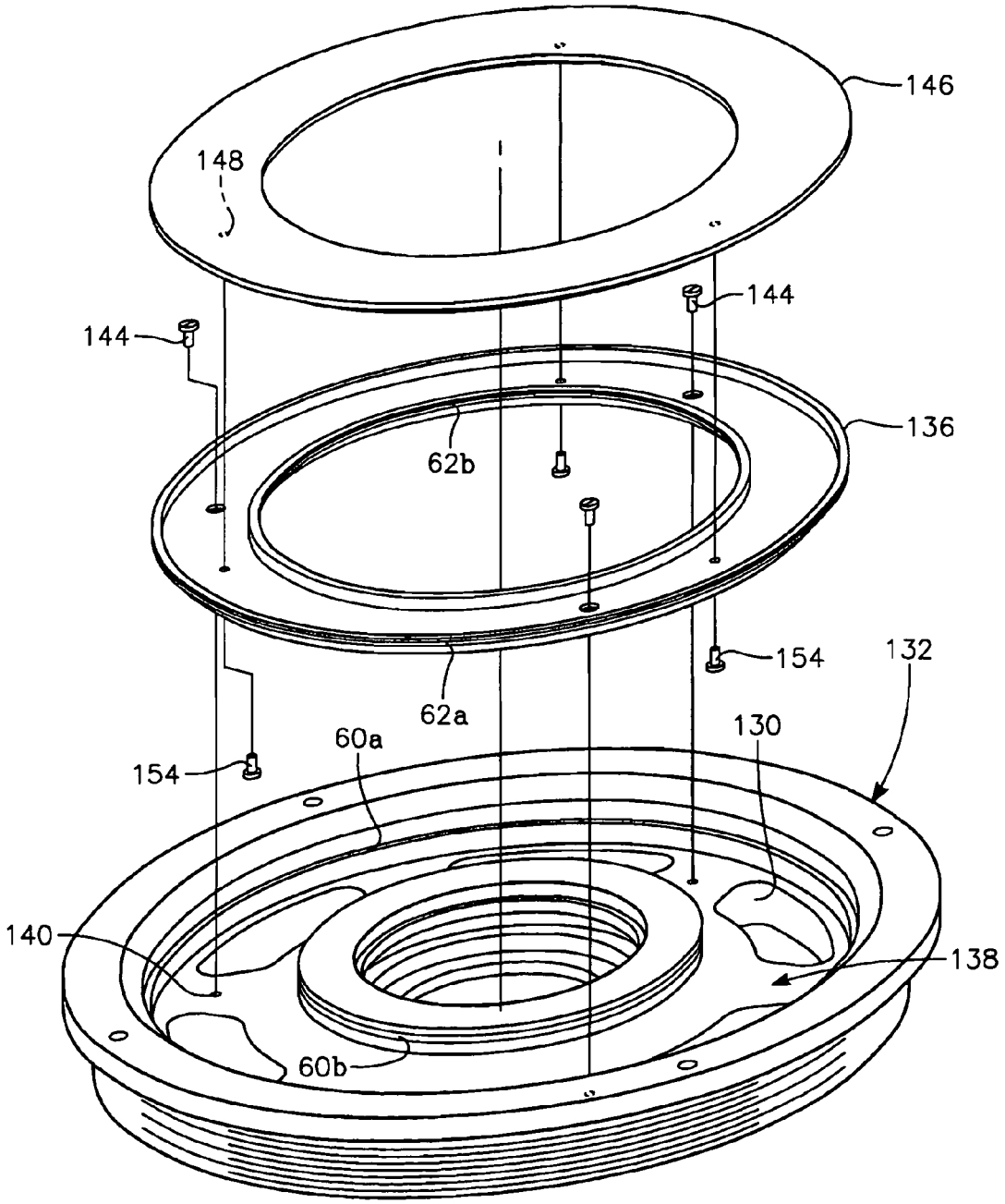
FIG. 11 is an exploded perspective view showing the retainer tab on the failure mechanism and showing the groove in the base plug.
Figure 12:
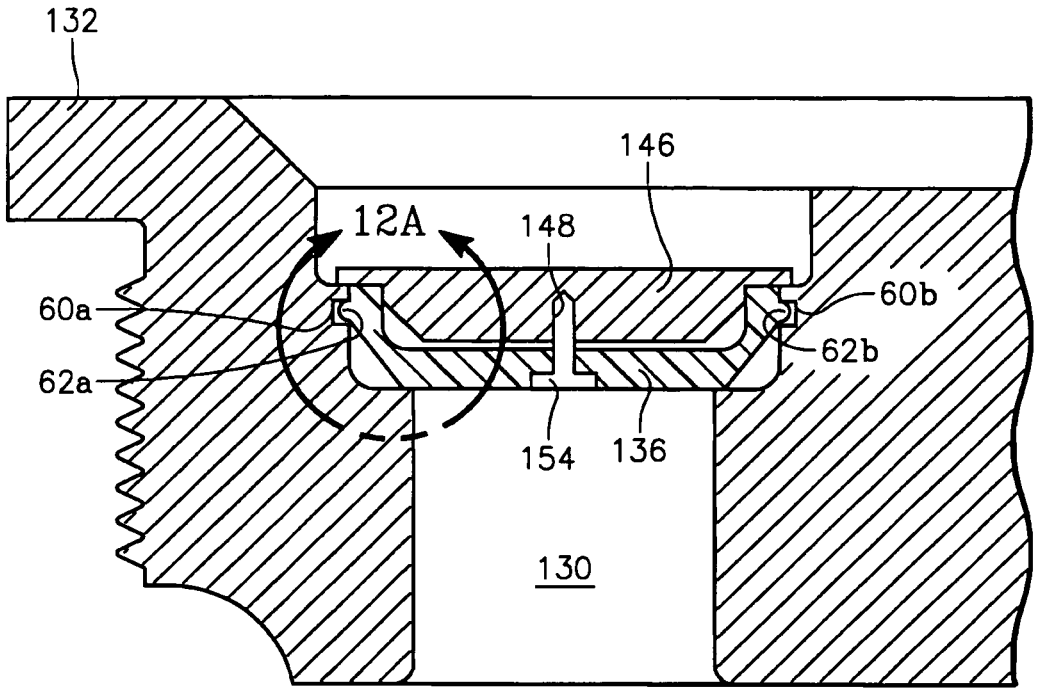
FIGS. 12 and 12A are expanded cross sectional views showing the retainer tabs mounted in the grooves.
Figure 12A:
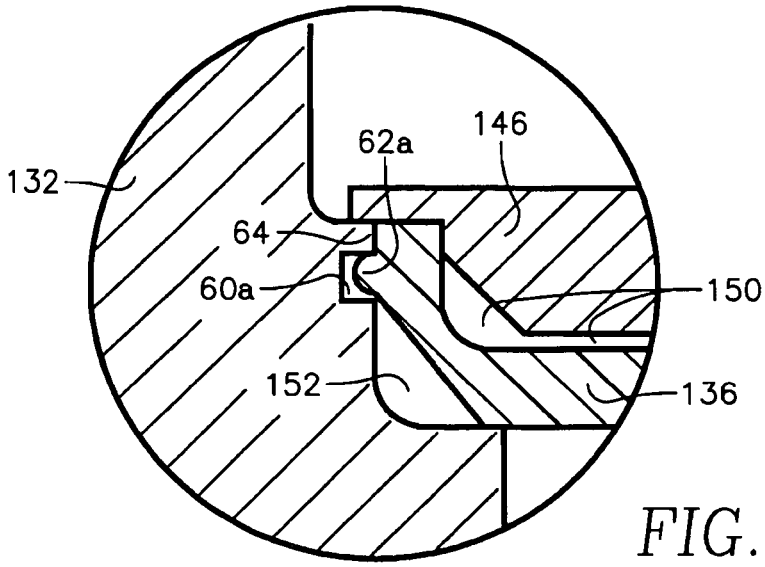

FIGS. 8, 9, 10A, 10B, 11, 12 and 12A show a second embodiment of the present invention. As shown in FIG. 11, the base plug 132 may include two circular grooves 60*a* and 60*b*. The failure mechanism 36 may include an outer edge tab 62*a* around an outer sidewall of base plug 132 that is inserted into the groove 60*b*. Also, failure mechanism may include an inner edge tab 62*b* around the inner sidewall of base plug 132 that is inserted into groove 60*b*. FIGS. 12 and 12A show details of the groove 60*a* and groove 60*b*. The groove 60*a* and groove 60*b* can be used along with fasteners 144 to secure the failure mechanism 136 to the base plug 132. The combination of the groove 60*a* and the tab 60*b* with and the fasteners 144 insures that failure mechanism 136 will remain attached to the base plug 132 until failure mechanism 136 melts, which releases failure mechanism 136 and insert ring 146 from the base plug 132 allowing for a controlled burn of the explosive material 24 within bomb casing 22.

The second embodiment of the invention uses the same part numbers as the first embodiment of the invention which is illustrated in FIGS. 3, 4, 5A, 5B, 6, 7 and 7A. For example, insert ring 46 of the first embodiment of the invention is identified by the reference numeral 146 in the second embodiment of the invention. Similarly, venting ports 30 of the first embodiment of the invention are identified by the reference numeral 130 in the second embodiment of the invention. Further, fasteners 44 and 54 of the first embodiment of the invention are identified by the reference numeral 144 and 154, respectively in the second embodiment of the invention.

From the foregoing, it is readily apparent that the present invention comprises a new, unique, and exceedingly useful vented base plug for a casing for holding an explosive material which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A venting system for a casing for containing an explosive material, comprising:

a base plug having a plurality of venting ports formed therein; wherein said base plug includes a generally ring-shaped indent and a generally ring-shaped failure mechanism formed to fit within said ring-shaped indent;

said generally ring-shaped failure mechanism is mounted to said base plug and arranged to seal each of said plurality of venting ports, said failure mechanism having a selected melting temperature such that exposure of said casing to an environment having a temperature that causes said failure mechanism to melt unseals each of the plurality of venting ports to allow controlled burning of said explosive material;

an insert ring mounted on an outer surface of the failure mechanism, said insert ring being formed of a durable material to protect said failure mechanism from being damaged; and wherein a first plurality of fasteners mounts said failure mechanism to said base plug and a second plurality of fasteners mounts said insert ring to said failure mechanism.

2. The venting system of claim 1 wherein an adhesive is placed between adjacent portions of said failure mechanism and said base plug and between adjacent portions of said insert ring and said base plug.

3. A venting system for a casing for containing an explosive material, comprising:

a base plug having a plurality of venting ports formed therein;

a generally ring-shaped failure mechanism mounted to said base plug and arranged to seal each of said plurality of venting ports, said failure mechanism having a selected melting temperature such that exposure of said casing to an environment having a temperature that causes said failure mechanism to melt unseals each of the plurality of venting ports to allow controlled burning of said explosive material;

an insert ring mounted on an outer surface of the failure mechanism, said insert ring being formed of a durable material to protect said failure mechanism from being damaged; wherein said insert ring is formed of a metallic material to provide shielding of said failure mechanism from exposure to electromagnetic fields external to said casing; and wherein a first plurality of fasteners mounts said failure mechanism to said base plug and a second plurality of fasteners mounts said insert ring to said failure mechanism.

* * * * *